United States Patent [19]

Beyen

[11] 4,390,040

[45] Jun. 28, 1983

[54] APPARATUS FOR ACCOMMODATING A SUBSTANCE TO BE SHIELDED FROM THE ENVIRONMENT

[75] Inventor: Heinrich Beyen, Wesseling, Fed. Rep. of Germany

[73] Assignee: Reederei und Spedition "Braunkohle" GmbH, Cologne, Fed. Rep. of Germany

[21] Appl. No.: 202,147

[22] Filed: Oct. 30, 1980

[30] Foreign Application Priority Data

Nov. 6, 1979 [DE] Fed. Rep. of Germany ..... 2944734

[51] Int. Cl.[3] ..... B65D 87/12; B65D 87/24

[52] U.S. Cl. ..... 137/340; 137/341; 137/899.1; 220/469; 252/633; 414/154; 414/292

[58] Field of Search ..... 137/340, 341, 899.1; 220/469; 250/506; 252/633; 414/154, 217, 287, 292

[56] References Cited

U.S. PATENT DOCUMENTS 1,088,453 2/1914 Roberts ..... 220/469 X

FOREIGN PATENT DOCUMENTS 1807295 5/1970 Fed. Rep. of Germany ..... 414/217

2359114 5/1975 Fed. Rep. of Germany .

*Primary Examiner*—Gerald A. Michalsky

*Attorney, Agent, or Firm*—Parmelee, Miller, Welsh & Kratz

[57] ABSTRACT

A transportable apparatus for accommodating a substance to be shielded from the environment, which may be disposed in a receptacle, has a pressure vessel provided with an opening which can be sealingly closed by a door with the substance therewithin, and a container within which the vessel is disposed.

20 Claims, 8 Drawing Figures

APPARATUS FOR ACCOMMODATING A SUBSTANCE TO BE SHIELDED FROM THE ENVIRONMENT

BACKGROUND OF THE INVENTION

It is usual in many cases for environmentally dangerous substances to be disposed in storage receptacles which are sealed with respect to the outside atmosphere, at least for a period of intermediate storage. A typical example of such a substance is uranium hexafluoride ($UF_6$) which, particularly in the depleted condition, that is to say, after a reduction in its U 235 content, is put into intermediate storage, until being finally eliminated or dumped, in sealed storage receptacles. As it is not always possible reliably to exclude the possibility of damage to such receptacles which are used for transportation and/or intermediate storage, it has been found necessary to make arrangements such that in situations in which the above-mentioned substances are not sufficiently shielded from the ambient atmosphere, for example due to damage to the receptacle or due to other circumstances, it is possible vary rapidly to take steps for restoring the desired situation, that is to say, a situation in which such substances are preserved or stored in a condition of being shielded from the environment. In this connection, it may be desirable, particularly also from the point of view of the necessity to act as rapidly as possible, to firstly provide provisional shielding for the substance, whereupon it is then possible, without the pressure of time, to take the steps which result in the substance being permanently disposed in and shielded in for example an intermediate storage means.

SUMMARY OF THE INVENTION

An object of the present invention is to provide a transportable apparatus for accommodating a substance to be shielded from the environment, into which such a substance can be rapidly and reliably introduced and sealed off.

Another object of the invention is to provide such an apparatus which is capable of receiving the largest receptacle that is normally employed for the storage and/or transportation of an environmentally polluting or harmful substance but which can also be transported using generally available means.

A further object of the invention is to provide an apparatus for accommodating a harmful substance, such that a harmful substance disposed therein, in a defective storage receptacle, is transferrable into a second intact receptacle.

A still further object of the present invention is to provide such an apparatus that a substance stored in a defective receptacle can be transferred into an intact receptacle without any necessity for operating personnel to come into direct contact with the substance and substantially without the danger of contamination in the area around the apparatus.

These and other objects are achieved by an apparatus which comprises a pressure-tightly closable vessel having an opening which can be sealingly closed as by a door. The vessel is disposed within a suitable containing means, such as a type of conventional cargo-handling container. The vessel is preferably substantially cylindrical, with the access opening and door provided at one of the ends thereof. The vessel is preferably fixedly mounted in the container, but it may be detachably secured thereto. An opening in the end of the container which provides access to the opening of the vessel can also be closed off as by a door.

A suitable sliding guide arrangement may be provided within the vessel and in a position such as to be extensible in front of the vessel, for receiving a carriage on which a harmful or polluting substance may be carried into the vessel. The slide guide means may include a slide guide track portion which is displaceable between an operative position in which it extends out of the container so that the carriage may be moved thereonto for receiving a substance as referred to above, and an inoperative or stored position in which the slide guide track portion is received within the vessel. Heating and/or cooling means are preferably associated with the vessel, while various conduits may be provided for feeding fluid into and removing fluid from the vessel in operation of the apparatus.

It will be seen therefore that the apparatus of this invention can act as a salvage or recovery means for receiving a storage receptacle which contains an environmentally polluting or dangerous substance and which has been damaged or become defective or leaky for some other reason. The apparatus can also be used for recovery of a receptacle which has suffered damage in the course of transportation, for example, to a storage means. The damaged receptacle is introduced into the vessel which is then sealed and the container containing the vessel and the harmful substance is picked up for example by a truck and taken to a location at which the contents of the damaged receptacle can be transferred into a sound receptacle. The container is preferably such that it can be handled using conventional container-handling equipment, while providing a protective function for the vessel. The apparatus therefore separates the function of the container, which is to make the apparatus easy to handle and in particular to make it transportable, from the function of the vessel which is to shield the harmful substances from the environment. By virtue of this separation, the container and the vessel can each be adapted to the respective functions that they are required to perform, to the optimum degree.

DESCRIPTION OF THE PREFERRED EMBODIMENT

Figure 1:
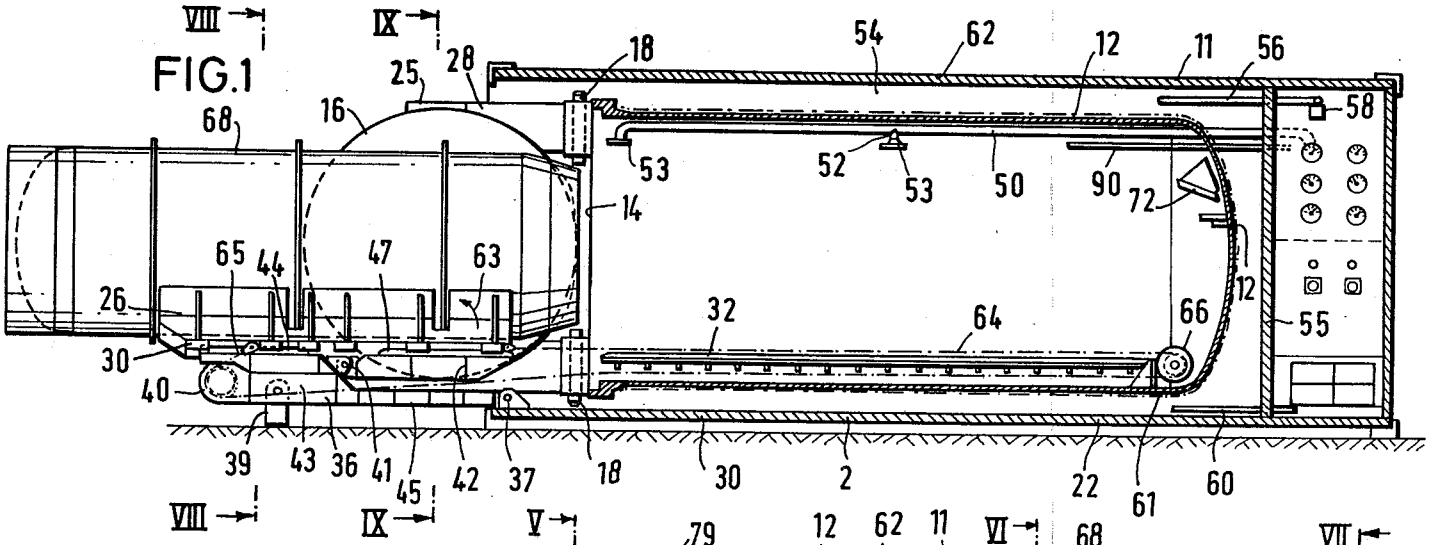
FIG. 1 shows a side view of apparatus for accommodating substances to be shielded from the environment, in an open condition.
Figure 2:
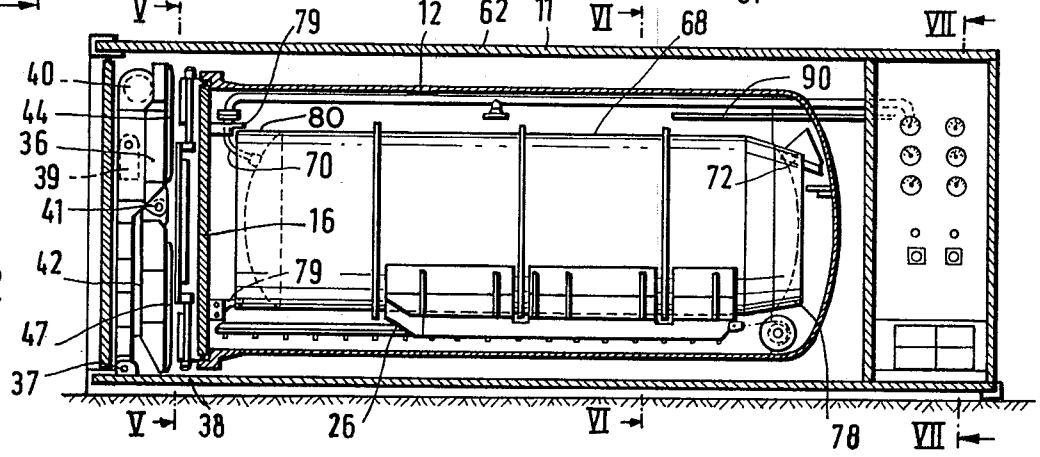
FIG. 2 shows a partly cross-sectional view, corresponding to FIG. 1, of the apparatus in a closed condition, with a receptacle within the apparatus.
Figure 3:
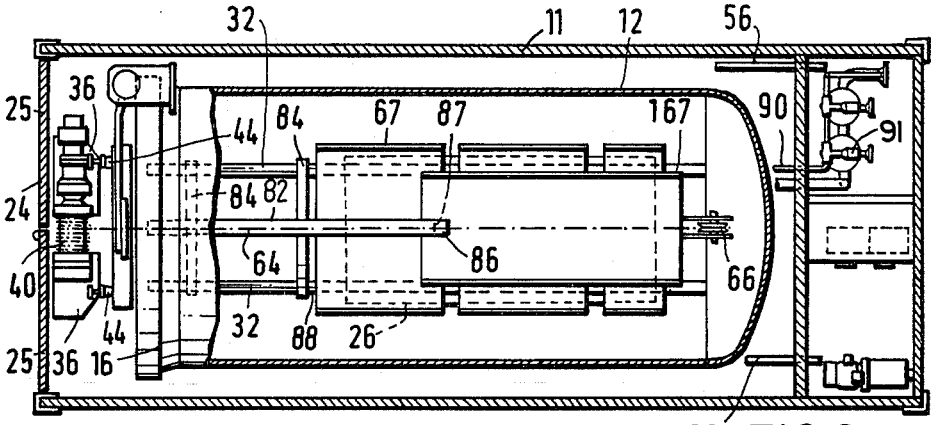
FIG. 3 shows a partly cross-sectional plan view of the apparatus of FIG. 2, without a receptacle therein.

Referring to the drawings, and in particular FIGS. 1, 2 and 3, the illustrated apparatus has an outer container 11 which is substantially square or rectangular in cross-section, and a substantially cylindrical pressure-tightly closable vessel 12, referred to hereinafter simply as the pressure vessel, which is preferably fixed mounted within the container. The pressure vessel 12 is provided with an opening 14 at one of its ends (see FIG. 1). The cross-section of the opening 14 is substantially identical to the free cross-section within the pressure vessel 12. The opening 14 can be pressure-tightly closed by means of a door 16 which is mounted on the pressure vessel 12 by means of two hinges 18 and two arms 19, in such a way that the door can be pivoted from the closed position shown in FIGS. 2, 3, 4 and 5 into the open position shown in FIG. 1, by a pivotal movement about a vertical axis, towards one side of the vessel 12. In the open position of the door 16, the opening 14 is accessible from the exterior, over the entire cross-section thereof. The door 16 can be secured in its closed position by suitable means (not shown in the drawings). For example, the door may be fixed in its closed position by the door on the one hand and the co-operating edge of the pressure vessel 12 on the other hand being adapted to be locked together in the manner of a bayonettype connection, for which purpose the door must be arranged so as to be rotatable over a short distance, relative to the arms 19.

The container 11 comprises a frame structure 22, and wall portions which comprise for example steel plate and which are mounted between or on the individual parts of the frame structure 22. The container 11 is provided with an opening 28 at the end of the container 11 which is adjacent the opening 14 in the pressure vessel 12. The opening 28 in the container 11 can be closed by means of a door 24 which comprises two movable door portions 25. The door portions 25 are mounted on the side walls of the container, so as to be pivotal about vertical axes.

Disposed within the pressure vessel 12 is a slide track which extends in the longitudinal direction of the pressure vessel 12 and which comprises two rails or bars 32, to serve as a guide for a carriage 26. The carriage 26 is provided on its underside with guide members 30 which extend in the longitudinal direction of the slide track and each of which has a slide surface 33 which is slidingly supported on the top surface of the respectively associated rail 32. The arrangement is also provided with guide bars 35 which are arranged laterally on the head or top portion of the respective rail 32, to provide for lateral guidance of the carriage 26. The slide surfaces 33 and the inside surfaces of the guide bars 35 may be provided with a frictionreducing coating, for example of Teflon (polytetrafluoroethylene). Each guide portion 30 is also provided with an extension portion 37 which engages under the respectively associated foot or base of the rail 32 and which serves to prevent the carriage 26 from lifting off the rails 32.

Figure 8:
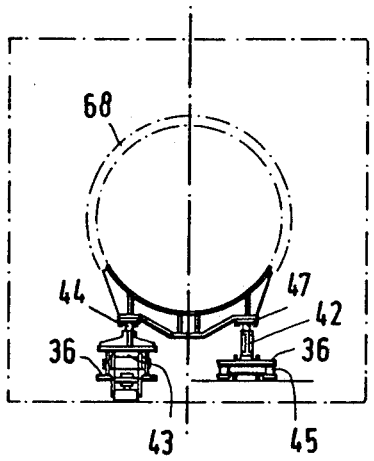
FIG. 8 shows a view in section taken along line VIII—VIII (left-hand side) and along line IX—IX (right-hand side) in FIG. 1.

The apparatus also has a device for loading and unloading the carriage 26. As shown in FIGS. 2 and 3, the device is disposed, when the container 11 is closed, between the pressure vessel 12 in the container, and the door 24 closing the container. The device which is pivotal with respect to the container serves to move the carriage 26 between a position within the vessel 12 and a position in which it is in front of the container 11, as shown in FIG. 2. The device comprises a frame arrangement which is mounted pivotally at 37 on the base 38 of the container. The frame arrangement comprises two parallel carrier members 36 which can be pivoted from the position shown in FIGS. 2, 3 and 4, in which the carrier members have been pivoted upwardly and are disposed between the pressure vessel 12 and the door 24, into the position shown in FIG. 1 in which the carrier members 36 extend substantially horizontally and in the longitudinal direction of the container 11. The two carrier members 36 are provided with pivotally mounted support members 39 which are adjustable in respect of height and which serve to support the free ends of the carrier members 36 on the ground. Adjacent their free ends which are at the left in FIG. 1, the two carrier members 36 carry an actuating means which, in the illustrated embodiment, is in the form of a rope or cable winch 40 which thus completes the above-mentioned frame arrangement, by combining with the carrier members 36 to form a U-shaped structure. In their end regions 43 which are adjacent the winch 40, the carrier members 36 are of such dimensions that, in the position shown in FIG. 1, when the support members 39 are suitably adjusted, a respective rail portion 44 mounted on each of the carrier members 36 is at the same position, in respect of height, as the rails 32 within the pressure vessel 12, and the two rail portions 44 thus form a track portion which aligns with the track formed by the two rails 32 in the pressure vessel 12. In addition, each carrier member 36 has a respective carrier portion 42 which is pivoted thereon at 41. The part of each carrier member 36, which is between the end regions 43 and the pivot point 37, is so dimensioned that the respectively associated carrier portion 42 is aligned with the top of the end regions 43, in the position of the carrier portions 42 as shown in FIGS. 1 and 8. On their top surfaces, the two carrier portions 42 also each carry a respective rail portion 47 so that, in the position shown in FIGS. 1 and 8, the track portion formed by the two rail portions 47 is aligned with the track 32 in the pressure vessel and the track portion formed by the rail portions 44. Thus, the track portions formed by the rail portions 44 and 47, in their downwardly pivoted position as shown in FIGS. 1 and 8, form an extension of the track formed within the pressure vessel 12 by the rails 36.

Figure 7:
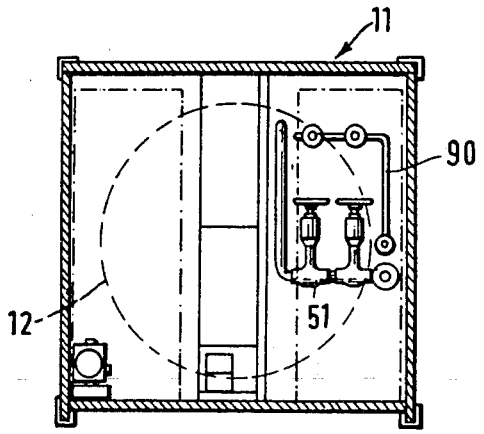
FIG. 7 shows a view in section taken along line VII—VII in FIG. 2.

Disposed within the pressure vessel 12 is a longitudinally extending pipe or conduit 50 which is pressure-tightly extended through an opening through the wall of the pressure vessel 12, at the end thereof which is remote from the opening 14. In the region outside the pressure vessel 12, the pipe or conduit 50 is provided with at least one shut-off member 51 (FIG. 7) which can be actuated from the exterior. Within the pressure vessel 12, a connecting member 52 branches off from the conduit 50; the connecting member 52 can be closed off by a blank or blind flange 53, as also can the free end of the conduit 50 which is within the pressure vessel 12.

The space 54 between the wall of the container 11 and the peripheral surface of the pressure vessel 12 and possibly also the end of the pressure vessel which is remote from the opening 14, said space being defined by a partitioning wall 55 at the end of the pressure vessel remote from the opening 28 in the container, is provided with a heating means and/or can be connected to a heating means. In the embodiment illustrated in the drawing, the assembly is provided for this purpose with a pipe or conduit 56 which terminates in the space 54 and which can be connected, outside of the space 54, to a supply conduit for steam, with the interposition of a shut-off member 58. A further conduit 60 sealingly extending through an opening in the wall of the vessel is provided for discharging condensate to the exterior. Instead of or possibly in addition to the above-mentioned steam-operated heating means, the apparatus may be provided with an electrical heating means, for example in the form of heating mats 61 which are disposed externally on the pressure vessel 12. The wall of the container 11 is also provided with suitable heat insulation as indicated at 62. Heat insulation may also be provided on or in the door 24. The apparatus may also have cooling means for temperature control of the pressure vessel.

In the use of the apparatus, as described hereinafter, it is assumed that a storage receptacle which is filled with environmentally dangerous or polluting material, for example $UF_6$, has been damaged or has in some other way become defective or leaky, so that it is necessary for the contents of the receptacle to be transferred into another storage receptacle; in this respect, it may be necessary for the defective receptacle with the material contained therein to be first transported from one place, to another place where the operation of transferring the contents of the receptacle is to be effected.

In use of the apparatus shown in the drawings, the door 24 is first opened. The carrier members 36 are then pivoted about the spindle 37 from the initial or rest position shown in FIGS. 2, 3 and 4, in which the carrier members 36 are within the container 11, outwardly into the position shown in FIGS. 1 and 8. Suitable actuating means which are known per se and which are therefore not shown in the drawings are provided for producing such outward pivotal movement of the carrier members 36. The support members 39 are also pivoted into the position shown in FIGS. 1 and 8. It is necessary for the carrier portions 42 to be pivoted about their pivots 41 towards the left in the direction indicated by arrow 63 in FIG. 1, so that the carrier portions 42 are outside the range of movement of the door 16 of the pressure vessel 12. The door 16 can then be opened and pivoted laterally through an angle of about 90°, into the position shown in FIG. 1 of the drawings. The carrier portions 42 are then pivoted back into the operative position shown in FIGS. 1 and 8, by being pivoted in the opposite direction to the direction indicated by arrow 63 in FIG. 1.

The carriage 26 which is normally within the pressure vessel 12 can then be slid from the pressure vessel 12 into the position shown in FIG. 1, that is to say, on to the track portions formed by the rail portions 44 and 47. In this position, the carriage 26 is outside the container 11 so that it is accessible from above and also from the sides. The carriage 26 is moved from the position shown in FIGS. 2 and 3 into the position shown in FIG. 1, by the winch 40 which is provided with two ropes or cables 64 and 65. The rope or cable 65 is secured directly from the winch 40 to the carriage 26 so that suitable actuation of the winch 40 produces the above-mentioned outwardly directed sliding motion of the carriage 26. The rope or cable 64 is passed around a direction-changing roller 66 which is disposed within the pressure vessel 12 at the end thereof remote from the opening 14. Thus, suitable actuation of the winch 40 causes the carriage 26 to be slid from the position of FIG. 1, inwardly into the pressure vessel 12.

Figure 6:
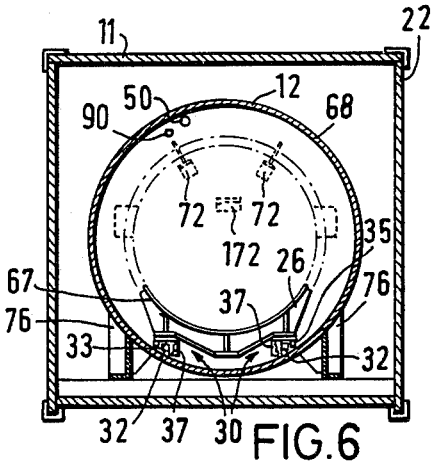
FIG. 6 shows a view in section taken along line VI—VI in FIG. 2.

As soon as the carriage 26 occupies the position shown in FIG. 1, an article which is to be introduced into the pressure vessel 12, for example the above-mentioned damaged storage receptacle 68, can be put on to the carriage 26. As can be seen in particular from FIG. 6 of the drawings, the carriage 26 is provided with support shell members 67 which are adapted to the shape of the receptacle 68. If required, the receptacle 68 can be secured to the carriage 26 in a suitable manner, for example using cables, chains or the like. Then, the carriage 26 with the receptacle 68 now disposed thereon is pulled into the pressure vessel 12, that is to say, moved into the position shown in FIG. 2, by suitably actuating the winch 40. FIG. 1 in particular shows that the number of guide portions 30 and the distances therebetween are so selected that the distances between the respectively associated rail portions 44, 47 and 32 can be readily bridged in the course of the movement of the carriage into the pressure vessel 12.

As soon as the carriage 26 with the receptacle 68 disposed thereon has reached the end or limit position shown in FIG. 2, the pressure vessel 12 is sealingly closed; before that is done, a communication may be made between the interior of the storage receptacle 68 and the conduit 50 which is at that time closed by the valve 51, such communication depending on the material in the receptacle 68 and the degree of damage to the receptacle 68. The above-mentioned communication is made by way of a hose portion 70 (see FIG. 2). The ropes or cables 64 and 65 can be released from the winch 40 before the pressure vessel 12 is closed, and laid into the pressure vessel. The carriage 26 and the storage receptacle 68 are locked in position within the pressure vessel 12. This is effected by means of clamping members 72 which are mounted on the pressure vessel 12 in the interior thereof and which engage over a protective apron portion 78 (see FIG. 2) mounted at the end of the receptacle 68, when the receptacle 68 is in the end position. In addition, in the closed condition of the door 16, projections 79 mounted on the inside of the door 16 engage into a protective apron portion 80 which is mounted at the other end of the storage receptacle 68.

Figure 4:
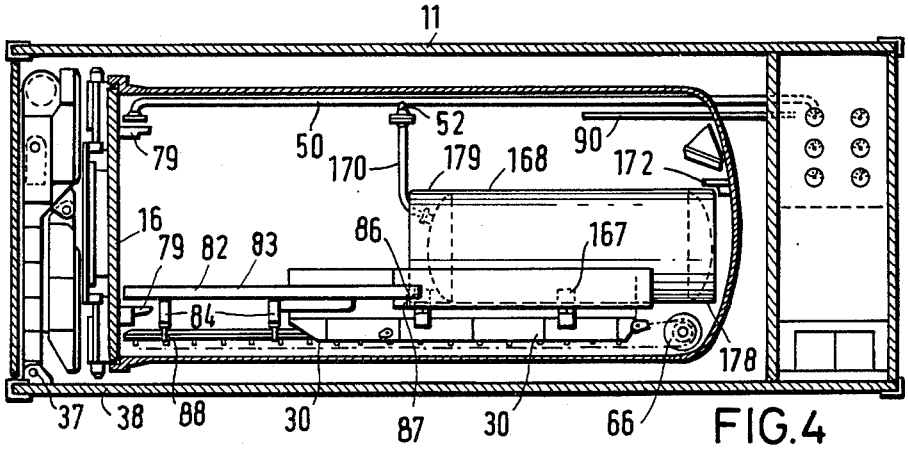
FIG. 4 shows a view corresponding to FIG. 2, with a smaller receptacle within the apparatus.
Figure 5:
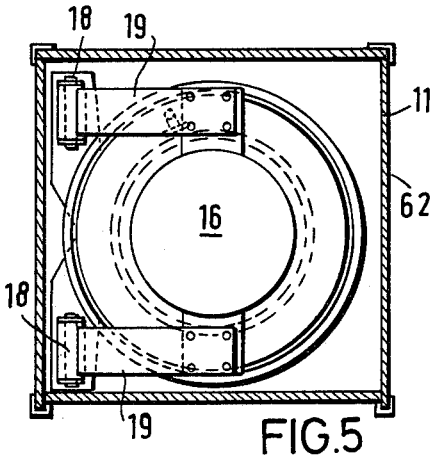
FIG. 5 shows a view in section taken along line V—V in FIG. 2.

Reference will now be made to FIG. 4 from which it will be seen that the structure shown therein differs from that shown in FIGS. 1 and 2 insofar as the storage receptacle 168 which is introduced into the pressure vessel 12 is substantially smaller. This therefore requires a modification in some parts of the apparatus of this invention, insofar as the apparatus has a special clamping member 172 which also engages over a protective apron portion 178 mounted on the receptacle 168, and thus secures in position the unit comprising the receptacle 168 and the carriage 26. As the receptacle 168 is too short for it to be secured in position by the clamping projections 79 on the inside of the door 16, the FIG. 4 apparatus also has a retaining or securing means 82 which essentially comprises a longitudinal carrier member 83 and two transverse carrier members 84. The length of the longitudinal member 83 is such that it can be clamped between the door 16 and a protective apron portion 179 on the end of the storage receptacle 168. It will be seen from FIG. 4 that, at its end which is towards the receptacle 168, the longitudinal member 83 is provided with a recess or opening 86 whose end wall 87 bears against the apron portion 179. The two transverse members 84 are provided with projections 88 which can be clamped fast to the rails 32 by means of screws or in some other suitable manner. Because of the small length of the receptacle 168, the receptacle 168 is connected to the conduit 50 at the connecting member 52, by way of a hose portion 170, whereas the free end of the conduit 50 is closed off by a blind flange 53.

Reference will now be made to FIG. 3 which shows that, when the pressure vessel 12 is empty, ie, without a receptacle therein, the securing means 82 serves to hold the carriage 26 in position. In that case, the end wall 87 of the recess or opening 86 bears against a suitable surface on the carriage 26, or a member secured thereto.

Because of the smaller diameter of the receptacle 168 of FIG. 4, it is necessary or at least advantageous for the support shell members of the carriage 26, which carry the receptacle 168, to be adapted to the diameter thereof. It will be seen from FIGS. 3 and 4 that, for this purpose, there are special support shell members 167 which can be releasably secured to the carriage 26.

The unit consisting of the pressure vessel 12 with the receptacle 68 or 168 disposed therein, and the container 11, can be moved, using conventional means and vehicles, to a position at which the conditions are best for transferring the material in the receptacle 68 or 168, into another receptacle. In the case for example of $UF_6$, this can be effected by a receiving receptacle, which may be another storage receptacle of suitable size, being sealingly connected to the end of the conduit 50 which is outside the pressure vessel 12. When the space 54 around the pressure vessel 12 is heated, the pressure and temperature in the pressure vessel 12 and in the receptacle 68 or 168 therein, also rise. When the material in the receptacle is $UF_6$, as mentioned above by way of example, sublimation takes place within the storage receptacle, with the result that, when the valve 51 is opened, the gases pass through the conduit 50 into the externally disposed receiving receptacle (not shown), and are then precipitated again. For this purpose it is necessary for a sufficiently low temperature to prevail in the receiving receptacle. By suitably controlling the heating means, it is readily possible at any time to control the operation in such a way that the temperature and pressure within the vessel 12 do not exceed a given, comparatively low value so that the design of the pressure vessel 12 is not subjected to any requirements which exceed the standards usually applied. Thus, it is sufficient for the pressure vessel to be designed for a pressure of 10 bars and a temperature of the order of 100° C. In the above-described operation of transferring $UF_6$ by means of sublimation, the pressure in the pressure vessel generally does not exceed a pressure above atmospheric of the order of 1 to 2 bars.

It is obviously also possible for the transfer operation to be performed in a corresponding manner, by producing a transition from a liquid into a gaseous phase or possibly from a solid phase by way of a liquid phase into a gaseous phase. After the receptacle 68 or 168 on the carriage 26 has been emptied, the container 11 and the pressure vessel 12 can be re-opened, possibly after having been transported to a special location suitable for that purpose, so that the carriage 26 with the receptacle which is now empty, can be moved back into the position of FIG. 1 and can be taken away. If necessary, the pressure vessel 12 and the carriage 26, and the other members used, for example the rope or cable, may be decontaminated.

In the embodiment illustrated in the drawings, the pressure vessel 12 is fixed on supports 76 which are fixedly mounted on the bottom of the container 11. Other configurations are also possible, for example designs in which the pressure vessel 12 is in fact secured in position but is releasably connected to the container 11.

The part of the container 11 which receives the pressure vessel 12 terminates at the partitioning wall 55, behind which the container 11 is provided with an extension chamber in which suitable accessories, fittings, operating elements and actuating means can be disposed.

Taking into account the requirements to be made in respect of the apparatus, it will be desirable for the pressure vessel to be about 10 cubic meters in size. This permits the entire apparatus to be of such a size as to at least approximate to a conventional container and thus permit transportation thereof, as a container, using conventional container-handling equipment. On the other hand, the pressure vessel 12 is then of sufficiently large size to receive a storage receptacle 68 which contains about 10 to 15 tonnes, for example, when dealing with $UF_6$.

If, as for example when handling $UF_6$, it is necessary for the pressure vessel 12 to be evacuated before a storage receptacle 68 or 168 is introduced thereinto, the pressure vessel 12 can be evacuated by way of the conduit 50.

The connecting hoses or pipes 70 and 170 are not necessary when the storage receptacle to be emptied, within the pressure vessel 12, is so severely damaged that the material therein can readily escape therefrom. In that case, it is only necessary to open the connecting member 52 and/or the free end of the conduit 50, within the pressure vessel 12.

It will be appreciated that it is also possible to use the above-described apparatus without the substance which is to be screened from the outside atmosphere being disposed in a storage receptacle, although under normal circumstances, the substance to be screened from the environment will in fact be in a storage receptacle, because otherwise substances of that kind cannot be readily preserved or transported.

The interior of the pressure vessel 12 is capable of being connected to a source for a gaseous medium, by way of a further conduit 90 which is pressure-tightly connected to the pressure vessel 12 and which has at least one shut-off member 91. The above-mentioned gaseous medium source can be used for example to introduce an inert gas into the interior of the pressure vessel. When transferring $UF_6$ from one receptacle to another, the above-used word 'inert' means that it is a gas which is substantially free from water vapour. Such a gas may be nitrogen. However, the introduction of inert gas may also be desirable if the substance in the pressure vessel is a substance of a combustible nature, it being understood that the apparatus is suitable for handling many different substances and is not limited to handling $UF_6$.

The above-described form of the apparatus takes essentially all practical requirements into account. Electrical heating for the pressure vessel 12 provides the advantage that the heating means can be operated anywhere, even if this is done by means of a generator driven by an internal combustion engine, whereas the steam-heated arrangement can normally only be used at locations at which steam is available.

Although the apparatus illustrated has a container 11 in the form of a normal cargo-handling container, the container for containing the pressure vessel 12 may be in the form of a container that for example can be fitted on to a lorry or truck chassis or the chassis of a railway truck. However, the illustrated apparatus with the separately handlable container, will generally be able to meet virtually all operational requirements.

It will also be noted that, in the embodiment illustrated in the drawings, the container projects beyond the pressure vessel at both ends so that the end regions of the pressure vessel are protected during transportation, even when the ends of the container are not actually closed.

It will be seen therefore that the above-described transportable apparatus is such that environmentally polluting or dangerous substances, which may be disposed in a receptacle, can be rapidly and reliably introduced into the apparatus and sealed off from the environment. This apparatus should be of such a size that on the one hand the largest storage and/or transportation receptacle normally employed can be disposed therein, but that on the other hand, the apparatus is capable of being transported using the usual means, that is to say, transportation means which are readily available. The apparatus is also of such a design that the substance disposed therein, which as mentioned may be for example within a defective storage receptacle, can be transferred into a second intact receptacle, without any necessity for operating personnel to come into direct contact with the substance, and without the danger of contamination in the area around the apparatus.

The above-described apparatus can thus readily fulfil the function of a salvage or recovery receptacle which, for example, when required, can be taken to an intermediate storage installation where there is a storage vessel containing an environmentally polluting or dangerous substance, which has been damaged or which has become defective or leaky for other reasons. A similar situation may also arise in regard to any other possible area of use, for example in the event of damage to a storage receptacle during transportation to the intermediate storage means. The damaged storage receptacle, or any other receptacle that may be employed, can be rapidly introduced into the pressure vessel of the apparatus, whereupon the pressure vessel can be pressure-tightly closed and the container picked up for example by a lorry or truck so that it can then be moved to a location at which the contents of the damaged receptacle are transferred into another receptacle. The outer container is advantageously of such a configuration that it is in conformity with the conventional sizes and shapes of container, and can therefore be handled using conventional means. At the same time it can have a protective function for the pressure vessel. Thus, the container is essentially provided to make the apparatus easy to handle and in particular to make it transportable, while the pressure vessel serves to shield the harmful substances from the environment. By separating these two functions, the container on the one hand and the pressure vessel on the other hand can each be adapted in the optimum manner to the respective functions to be performed by the container and the pressure vessel.

Various modifications may of course be made in the above described apparatus without thereby departing from the spirit and scope of the present invention.

What is claimed is:

1. Apparatus for accommodating a substance to be shielded from the environment, comprising: a vessel for receiving a said substance, having an opening; a door for sealingly closing said opening; a first guide means disposed within the vessel and extending from the opening thereof into the vessel; a carriage for carrying a said substance, movable on the first guide means; a second guide means adapted to have an operative position in which said second guide means is aligned with said first guide means and in which said carriage is supported on said second guide means outside said vessel; means for displacing the carriage along said first and second guide means; means for securing the carriage in position in the vessel, conduit means for introducing fluid into and removing fluid from said vessel; and a container adapted to contain said vessel.

2. Apparatus as set forth in claim 1 wherein said second guide means is pivotal between said operative position and an inoperative position in which it is disposed within said vessel.

3. Apparatus as set forth in claim 1 wherein said carriage is adapted to receive a receptacle containing a said substance.

4. Apparatus as set forth in claim 1 and further including means for controlling the temperature of said vessel.

5. Apparatus as set forth in claim 1 wherein said container includes a separating wall adapted to separate the interior of the container into a first part adapted to receive said vessel and a second part for accommodating operating and control means.

6. A transportable apparatus for accommodating a receptacle containing a substance to be shielded from the environment, comprising: a container, a substantially cylindrical pressure vessel mounted in said container and having an opening provided at one end, means for sealingly closing said opening, first guide means disposed within said vessel and extending from the opening into said vessel, a carriage for receiving said receptacle and movable on the guide means, and means for locking the carriage in position in said vessel.

7. Apparatus as set forth in claim 6 wherein the container is provided with a pivotally mounted frame arrangement having further guide means for the carriage, wherein said frame arrangement is adapted to occupy an operative position in which said further guide means is disposed in front of said vessel and the container, in line with said first guide means.

8. Apparatus as set forth in claim 7 wherein said frame arrangement is pivotally mounted within the container adjacent the bottom thereof and is adapted to occupy a rest position in which it is disposed between an opening into said container and said opening of said vessel.

9. Apparatus as set forth in claim 7 wherein said frame arrangement has two carrier members which extend parallel to the longitudinal direction of the container, when the frame arrangement is in its said operative position, and which carry said further guide means.

10. Apparatus as set forth in claim 7 wherein said frame arrangement carries actuating means for moving the carriage along the guide means.

11. Apparatus as set forth in claim 6 wherein said means for locking said carriage in position comprises a securing means within said vessel for locking the carriage in a given position therein.

12. Apparatus as set forth in claim 6 wherein said means for locking said carriage in position includes projection means on the inwardly facing surface of the door closing the opening of said vessel, the projection means, in the closed position of said door, being operable to lock the carriage in a given position in said vessel.

13. Apparatus as set forth in claim 6 wherein said vessel has a wall provided with at least one opening therethrough, and a conduit incorporating at least one shut-off means, for the removal of fluid from the pressure vessel, is pressure-tightly connected to said vessel through said one opening.

14. Apparatus as set forth in claim 13 wherein said conduit extends into said vessel and is provided with at least a means for mounting a connecting conduit therein.

15. Apparatus as set forth in claim 14 wherein said vessel has a wall provided with a second opening therethrough, and a second conduit which is adapted selectively to be shut off, for the introduction of a gaseous medium, is pressure-tightly connected to said second opening.

16. Apparatus as set forth in claim 6 including means for temperature control of said vessel.

17. Apparatus as set forth in claim 16 wherein said temperature control means is arranged externally on said vessel.

18. Apparatus as set forth in claim 6 wherein said container has an access opening at at least one end and includes operating and control means arranged at the end of the container remote from said access opening.

19. Apparatus as set forth in claim 18 including a partitioning wall for separating a part of the container which receives said vessel from a part of the container which accommodates said operating and control means.

20. Apparatus as set forth in claim 6 wherein said vessel is capable of receiving a said substance in a receptacle.

* * * * *